US007168645B2

(12) United States Patent
Blatton et al.

(10) Patent No.: US 7,168,645 B2
(45) Date of Patent: Jan. 30, 2007

(54) LIFT WALL FOR A TUBE MILL

(75) Inventors: Gerhard Blatton, Beckum (DE); Hubert Grothaus, Bad Iburg (DE); Ludger Schulte, Ahlen (DE)

(73) Assignee: Polysius AG (DE)

( * ) Notice: Subject to any disclaimer, the term of this patent is extended or adjusted under 35 U.S.C. 154(b) by 481 days.

(21) Appl. No.: 10/343,753

(22) PCT Filed: Jun. 4, 2002

(86) PCT No.: PCT/EP02/06131

§ 371 (c)(1),
(2), (4) Date: Feb. 3, 2003

(87) PCT Pub. No.: WO02/098564

PCT Pub. Date: Dec. 12, 2002

(65) Prior Publication Data

US 2003/0111567 A1 Jun. 19, 2003

(30) Foreign Application Priority Data

Jun. 5, 2001 (DE) ..... 101 27 258

(51) Int. Cl.
*B02C 17/06* (2006.01)

(52) U.S. Cl. ..... 241/301; 241/57; 241/71

(58) Field of Classification Search ..... 241/57, 241/78, 70–72, 171, 176, 179, 301
See application file for complete search history.

(56) References Cited

U.S. PATENT DOCUMENTS 4,089,476 A * 5/1978 Gauer ..... 241/70

* cited by examiner

*Primary Examiner*—Mark Rosenbaum
(74) *Attorney, Agent, or Firm*—Muramatsu & Associates

(57) ABSTRACT

A lifting wall for a tube mill which has a discharge means with lifting vanes in order to transport the material being ground to discharge openings by the rotary movement of the tube mill. The lifting vanes are disposed obliquely with respect to the radial direction so that the material being ground slides promptly to the center where it is discharged through the discharge openings still below the horizontal longitudinal central plane of the tube mill. The lifting vanes are substantially flat and bent like blades in a region of the discharge openings.

9 Claims, 5 Drawing Sheets

LIFT WALL FOR A TUBE MILL

BACKGROUND OF THE INVENTION

In tube mills, intermediate walls serve the purpose of separating the grinding media charge of adjacent grinding chambers from one another and of transporting the material being ground from one chamber to the other. For this purpose, a discharge means is usually disposed in the intermediate wall, and through this discharge means, the material being ground which passes via inlet openings into the intermediate chamber is transported via discharge openings into the second grinding chamber.

Discharge chambers are disposed at the end of the tube mill and are also equipped with a discharge means in order to discharge the finished ground material.

From DE-C-26 13 062, a lifting wall for a tube mill is known which comprises:

- a front face which is provided in inlet openings through which material being ground passes into the wall,
- a rear face with discharge openings through which the material being ground which is located in the lifting wall is discharged,
- a central air duct for an air stream which is led through the tube mill, wherein the air duct has an air intake opening in the front face and an air outlet opening in the rear face of the lifting wall and the discharge openings are disposed in an annular region around the air outlet opening,
- and a discharge means.

The discharge means has lifting vanes which are adjustable in the radial direction. Due to the rotary movement of the tube mill, the material being ground is lifted upwards over the lifting vanes and then slides thereon to the enter where it is discharged through the discharge openings.

In DE-B-22 07 484, a lifting wall is proposed in which the volume of the lifting vanes can be altered by rotation of the vanes. In another embodiment from this publication, in the region of the discharge opening of the intermediate wall, there is disposed a truncated cone with a movable closure ring which, depending upon its position, allows a greater or a lesser discharge of material being ground.

However, the known discharge means have the disadvantage that the material being ground which is transported via the lifting vanes to the center is discharged in such a way that it is fed into the air stream which is led through the tube mill. This in turn leads to a situation where the discharged material being ground does not pass immediately after the intermediate wall into the ball charge of the second grinding chamber but rather is pneumatically introduced more or less far into the second grinding chamber. However, as a result, the ball charge is not fully utilised, which results in reduced efficiency.

SUMMARY OF THE INVENTION

The object of the invention, therefore, is to make further developments to the lifting wall for tube mills in such a way that the material being ground which comes out through the discharge openings on the rear face of the lifting wall is not fed into the air stream which is led through the center of the intermediate wall.

The lifting wall according to the invention for a tube mill consists essentially of

- a front face which is provided in inlet openings through which material being ground passes into the wall,

- a rear face with discharge openings through which the material being ground which is located in the lifting wall is discharged,
- a central air duct for an air stream which is led through the tube mill, wherein the air duct has an air intake opening in the front face and an air outlet opening in the rear face of the lifting wall and the discharge openings are disposed in an annular region around the air outlet opening,
- and a discharge means with lifting vanes which transport the material being ground to the discharge openings by the rotary movement of the tube mill.

The lifting vanes are disposed obliquely with respect to the radial direction. Due to this oblique arrangement, the material lifted by the lifting vanes slides to the centre where it reaches the associated discharge openings before these latter are located above the horizontal longitudinal central plane of the tube mill. As a result, the material being ground which comes out through the discharge openings on the rear face of the lifting wall is not fed into the air stream which is led through the center of the intermediate wall but rather it passes directly after the lifting wall into the ball charge of the second grinding chamber or into the discharge housing disposed downstream of the ball mill.

In a preferred embodiment, the lifting vanes are bent like a blade in the region of the discharge openings in order to facilitate the discharge of the material being ground.

According to a further embodiment, at least some of the lifting vanes are adjustable in length. In this way, a constant level of material being ground can be achieved in the grinding chamber. In a preferred embodiment, some lifting vanes which are firmly installed and some lifting vanes which are adjustable in length are provided, wherein the lifting vanes which are firmly installed reach from the outer casing of the lifting wall as far as the discharge openings but only extend over a part of the cross-sectional surface. The lifting vanes which are adjustable in height preferably extend over the entire cross-sectional surface. In this way, the fixed lifting vanes, depending upon the width, transport approximately 30 to 70%, preferably 50% of the material being ground, whilst the rest can be conveyed by the lifting vanes which are adjustable in length. In this case, the level of the material being ground in the grinding chamber is set as a function of the position of the adjustable lifting vanes. With such an arrangement, a constant level of material being ground can also be achieved in the event of a change in the throughput quantity, since the quantity conveyed by the adjustable vanes changes and not the level of the material being ground as the throughput quantity through the tube mill varies.

BRIEF DESCRIPTION OF THE DRAIWNGS

Further advantages and embodiments of the invention are explained in greater detail with reference to the following description and the drawings.

FIGS. 4*a* to 4*d* show three-dimensional representations of the individual elements of the lifting vanes.

Figure 5:
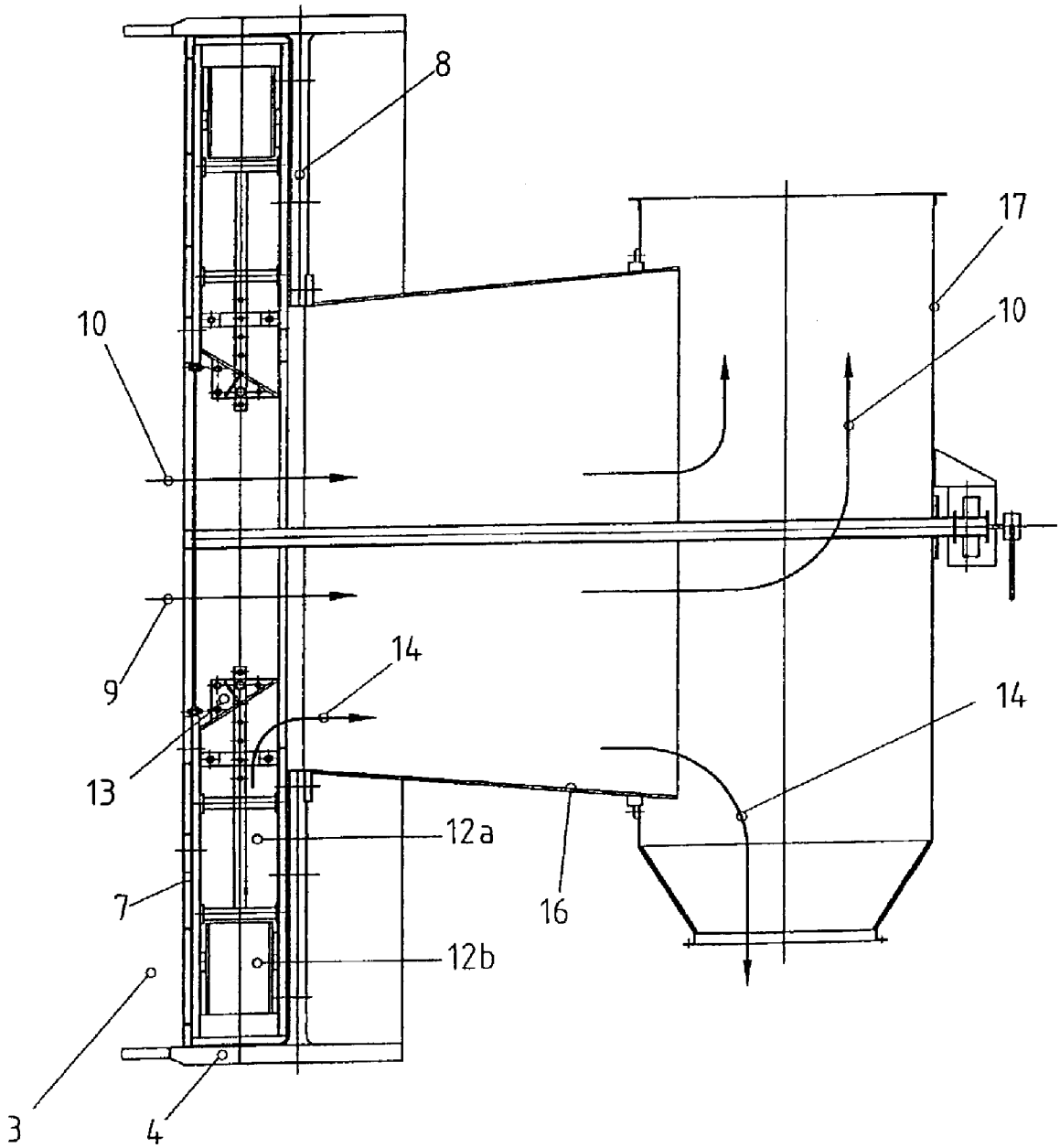

FIG. 5 shows a schematic longitudinal sectional representation in the region of a discharge wall.

DETAILED DESCRIPTION OF THE INVENTION

Figure 1:
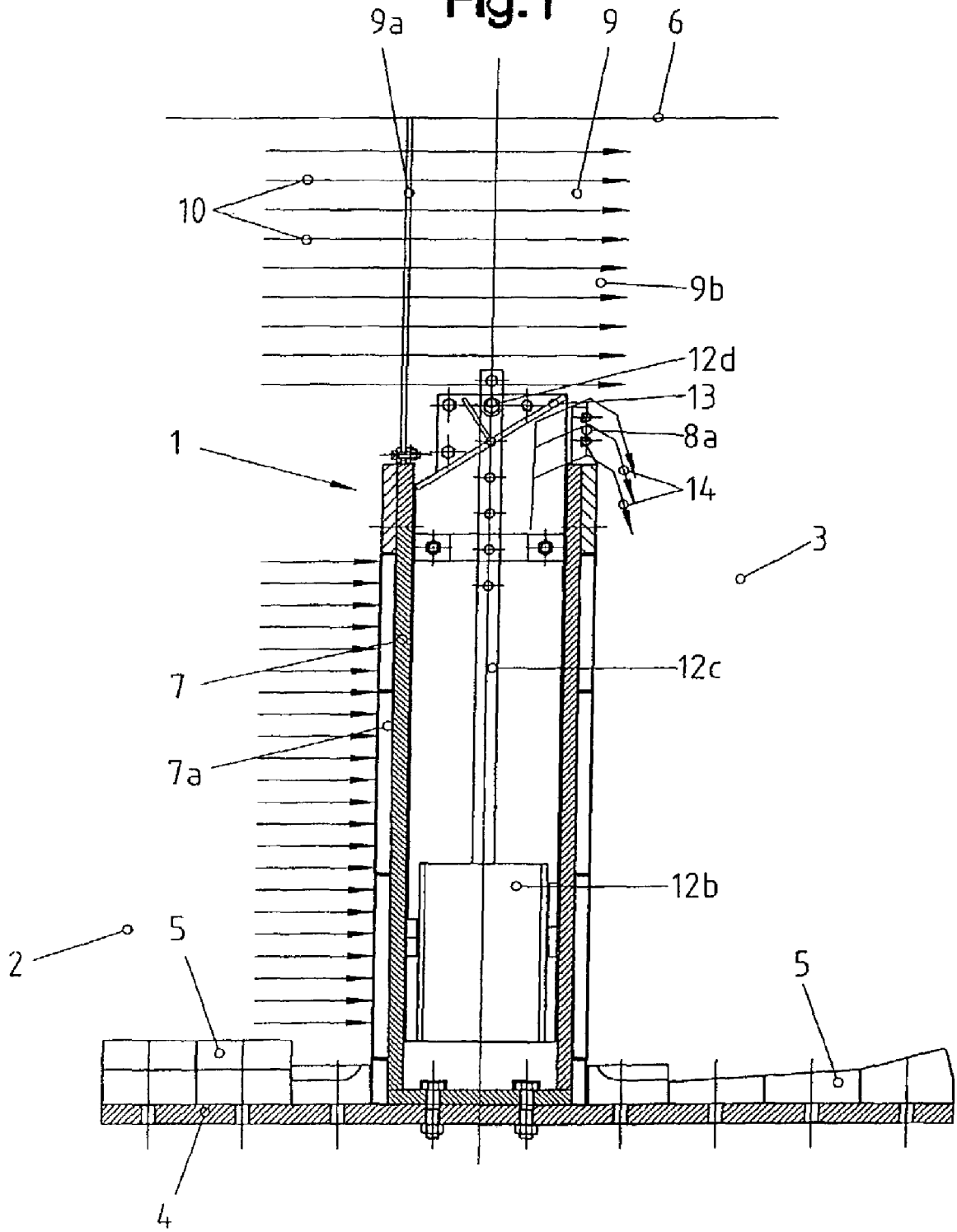
FIG. 1 shows a schematic longitudinal sectional representation in the region of an intermediate wall.

The partial view of a tube mill represented in FIG. 1 shows principally an intermediate wall 1 which divides the tube mill into a first grinding chamber 2 and a second grinding chamber 3. The tube mil also has a cylindrical outer casing 4 which is provided in each of the two grinding chambers 2, 3 with a lining 4. The tube mill is mounted so as to be rotatable about its axis 6 in the usual way.

Each grinding chamber is provided with grinding balls which effect a size reduction of the material being ground due to the rotary movement of the tube mill.

The intermediate wall 1 serves, on the one hand, for separation of the grinding balls of different sizes which are present in the two grinding chambers and, on the other hand, for transferring the material being ground from the first grinding chamber 2 to the second grinding chamber 3.

Figure 2:
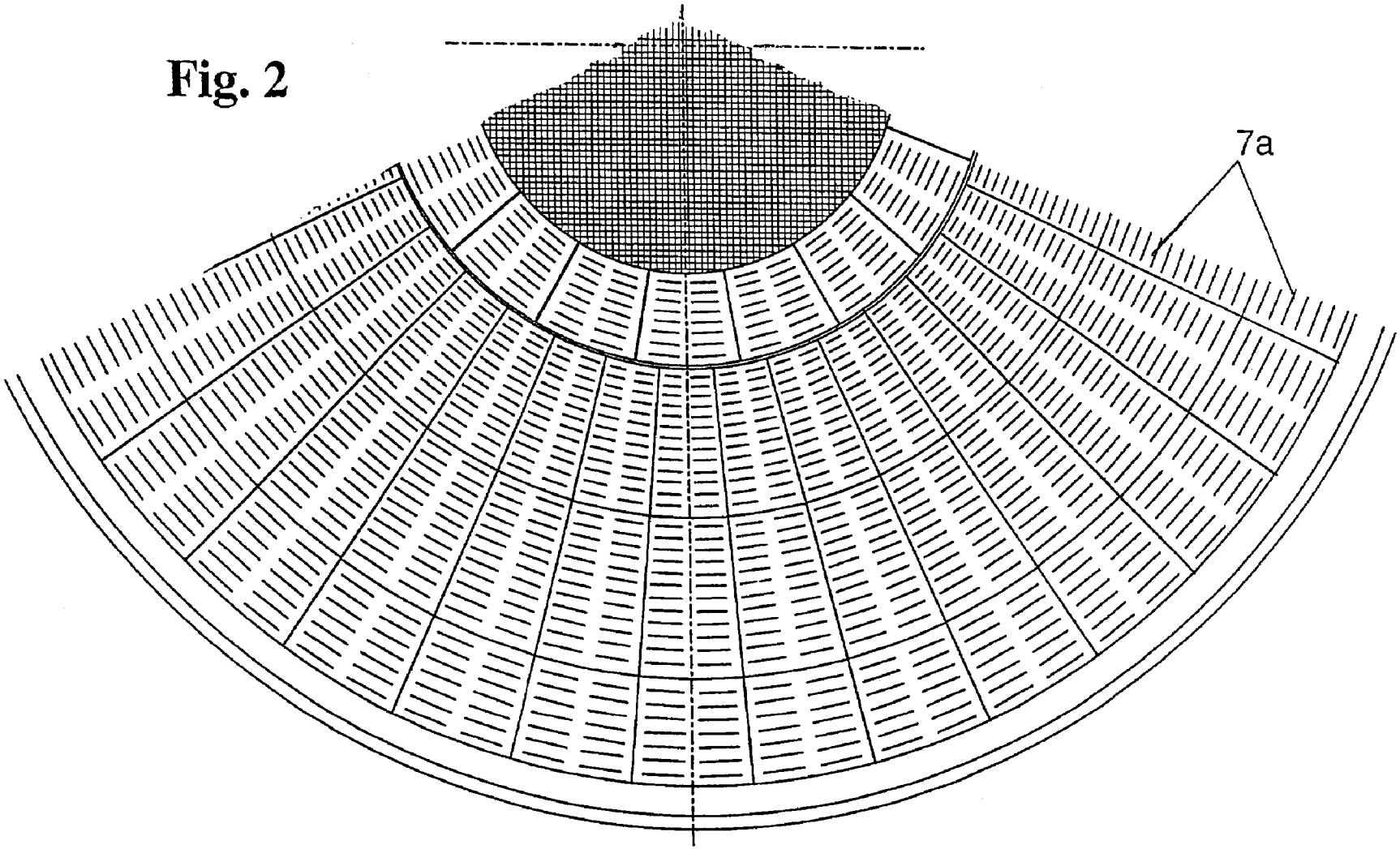
FIG. 2 shows a schematic partial view of the front face of the intermediate wall.

The intermediate wall 1 is provided with a front face 7 which is directed towards the first grinding chamber 2 and which has inlet openings 7*a* through which material being ground passes into the intermediate wall. As can be seen particularly from FIG. 2, the inlet openings 7*a* are disposed in the outermost annular portion of the front face 7. The inlet openings 7*a* are constructed as slots in slotted plates, and a plurality of slotted plates disposed above one another and adjacent to one another form the annular outer region of the front face.

The intermediate wall 1 also has a rear face which is directed towards the second grinding chamber 3 and is provided with discharge openings 8*a* through which the material being ground which is located in the intermediate wall 1 passes into the second grinding chamber 3. As can be seen from FIG. 3, the discharge openings 8*a* are also constructed in the form of slots and disposed in a central annular region around the axis 6. The outer annular region, which corresponds approximately in size to the annular region of the front face which is provided with the inlet openings 7*a*, is of closed design here and again is formed by a plurality of rear wall plates.

The intermediate wall 1 also provides a central air duct 9 for the air stream 10 which is led through the tube mill, the air duct having an air intake opening 9*a* in the front face 7 and an air outlet opening 9*b* in the rear face 8 of the intermediate wall 1, wherein in particular the air intake opening 9*a* can be provided with a grating.

In the intermediate chamber, there is provided a discharge means with lifting vanes 11, 12 by which the material being ground is transported to the discharge openings 8*a* by the rotary movement of the tube mill. The special feature of these lifting vanes resides in the fact that they are disposed obliquely with respect to the radial direction. The lifting vanes are preferably disposed at an angle a of 15 to 30° with respect to the radial direction (see FIG. 3).

Figure 3:
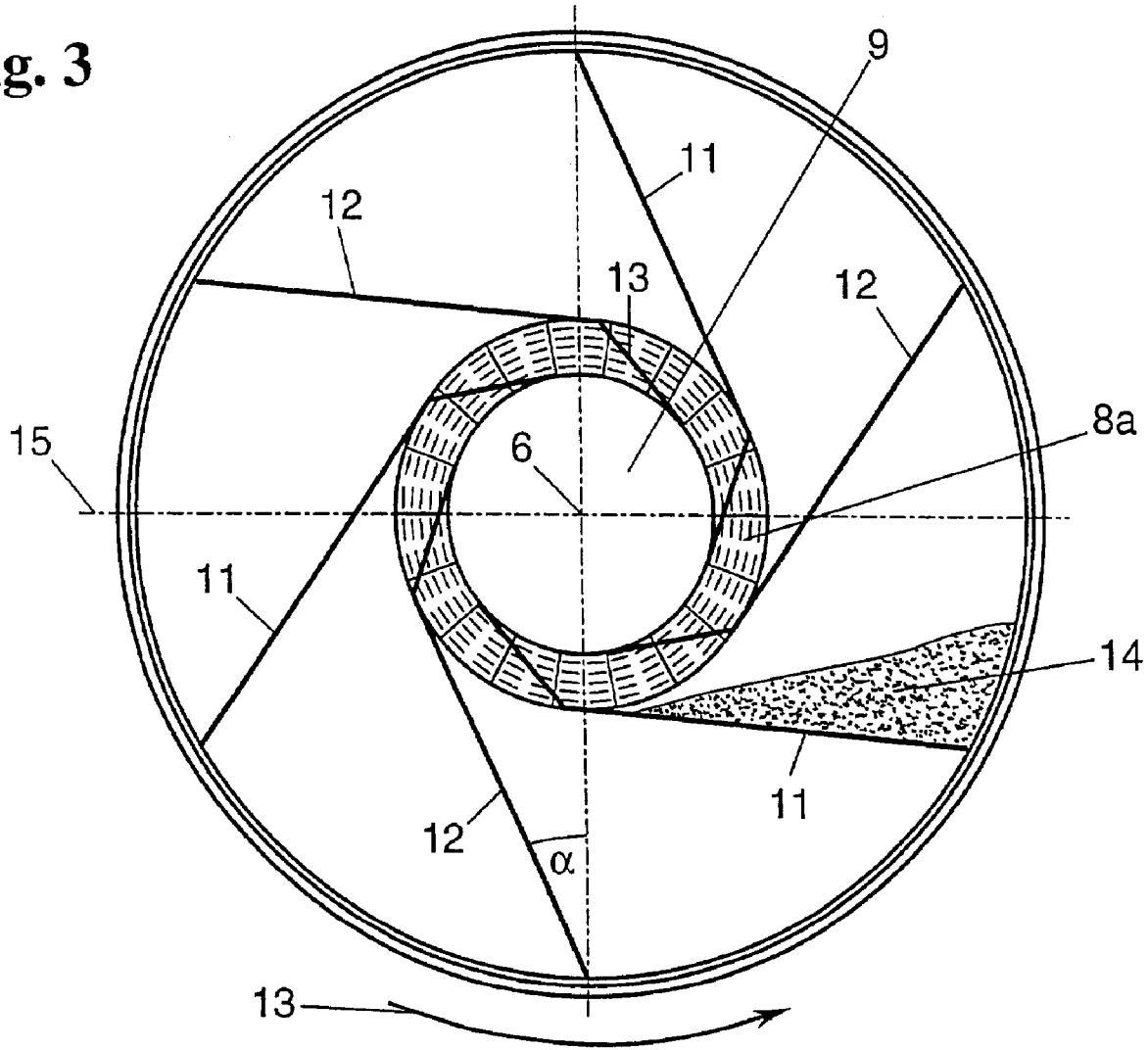
FIG. 3 shows a schematic cross-sectional representation along the line III—III in FIG. 1.

In the view according to FIG. 3, the tube mill rotates anticlockwise (arrow 13). The material located in the intermediate wall is taken up by the lifting vanes and transported upwards. Due to the oblique arrangement of the lifting vanes 11 and 12, the material being ground 14 which is located on the lifting vanes slides to the center and thus to the discharge openings 8*a*. Thus, the material being ground 14 already passes to the discharge openings before this region of the discharge openings 8*a* is located above the horizontal longitudinal central plane 15 of the tube mill. Thus, the material being ground 14 enters the second grinding chamber 3 below the horizontal longitudinal central plane 15 and is not fed into the air stream 10 which is led through the center. Therefore, the material being ground passes through the discharge openings on the rear face of the intermediate wall 1 and directly into the ball charge of the second grinding chamber 3. Thus, the entire ball charge of the second grinding chamber 3 can be utilised, since due to the separate guiding of the air and the discharge of the material being ground 14 from the discharge wall 1 below the horizontal longitudinal central plane 15, the material being ground is prevented from being pneumatically transported far into the second grinding chamber 3.

In order to assist the discharge of the material being ground 14, the lifting vanes 11 and 12 have a vane head 13 bent like a blade in the region of the discharge openings 8*a* (see FIG. 3).

The lifting vanes 11, 12 are explained in greater detail below with reference to FIGS. 4*a* to 4*d* as well as FIG. 1:

In the illustrated embodiment, the lifting vanes 11 which are firmly installed and lifting vanes 12 which are adjustable in length are provided alternately. The fixed lifting vanes 11 reach from the outer casing 4 as far as the discharge openings 8*a*. However, they only extend over 30 to 70%, preferably 50% of the cross-sectional surface. Thus, depending upon the size, the fixed lifting vanes convey 30 to 70% of the total material being ground.

Figure 4A:
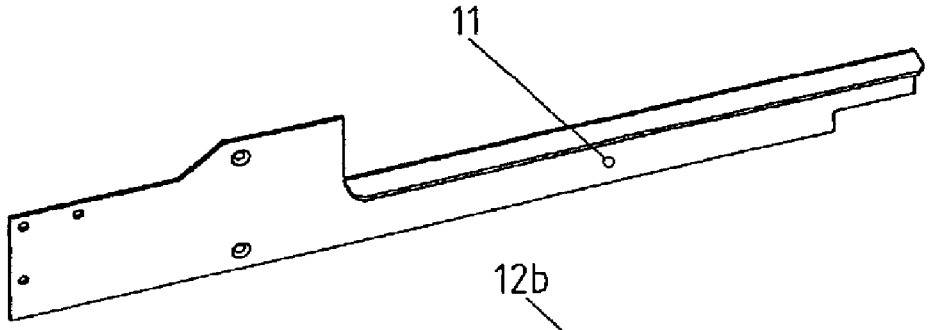
Figure 4B:
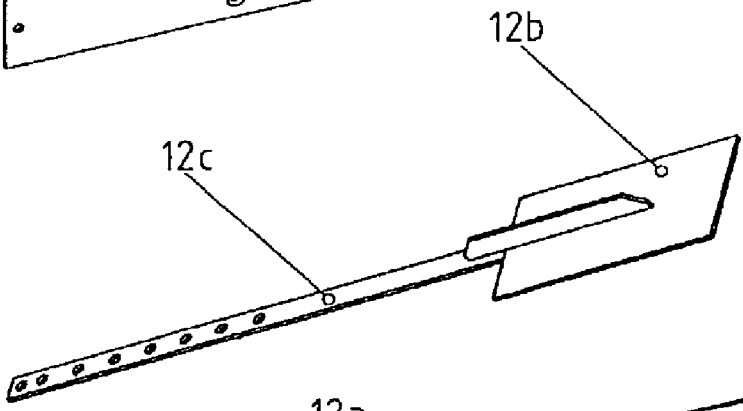
Figure 4C:
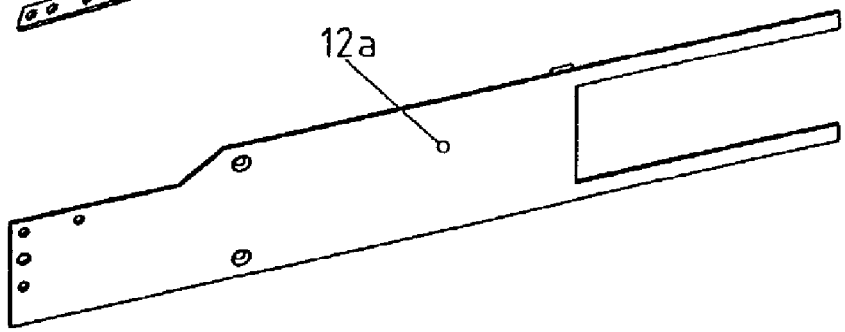
Figure 4D:
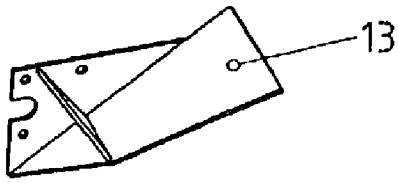

The lifting vanes 12 which are adjustable in length have a fixed part 12*a* and a displaceable slide 12*b*. The displacement is carried out by way of a displacement mechanism which can preferably be actuated in the region of the air duct 9. In the illustrated embodiment the slide has a perforated rod 12*c*. The slide 12*b* can be secured in the region of the air duct by way of the perforated rod 12*c* by means of a bolt or a screw 12*d*. FIGS. 1 and 4*d* show the vane head 13 which is bent like a blade and forms a vertical limit for the material being ground 14 which slides down on the lifting vane, wherein this vane head 13 is disposed at an angle between 30 and 60° to the longitudinal extent of the lifting vanes so that the material sliding to the vane head 13 is led through the discharge openings 8*a*.

The lifting vanes 11 and 12 are of substantially flat construction, but can also have another shape, for example a trough shape. Preferably at least some of the lifting vanes 11, 12 can be adapted in their width to the quantity of material being ground.

Depending upon the material being ground and the type and quantity of grinding media, there is an optimal level of material being ground in the first grinding chamber 2. In the discharge means described above, the optimal level of material being ground in the first grinding chamber 2 can be set by the length of the adjustable lifting vanes 12. Due to the fact that the fixed lifting vanes reach as far as the outer casing 4 and are only reduced in width, the material being ground 14 can enter the intermediate wall 1 over the entire filled height of the first grinding chamber 2. Also the material being ground 14 is taken up and discharged over the entire height of the intermediate wall 1. Thus, there is no fixed baffle edge for the material being ground, but there is an adjustable baffle height.

Due to the lifting vanes which are disposed obliquely with respect to the radial direction, the material being ground 14 passes directly behind the intermediate wall 1 into the second grinding chamber 3 without being fed into the air stream. Thus, the separation of air and material ensures an optimal use of the ball charge of the second grinding chamber 3. The discharge openings 8*a* have a sufficiently large free cross-section in order to ensure a rapid discharge. In addition to slotted plates with sufficiently large slots, bars can also be provided in this region.

A special feature resides in the fact that the level of the material being ground 14 in the intermediate wall 1, and thus level of material being ground 14 in the first grinding chamber 2, does not change as the throughput quantity through the tube mill varies. The level of material being ground 14 is determined solely by the position of the slide 12*b* of the adjustable lifting vanes 12. Thus, in the event of a variation in the throughput quantity, it is merely the quantity conveyed by the adjustable lifting vanes 12 which changes and not the level of material being ground 14.

The lifting wall described above can also be provided with the same construction for the so-called discharge wall. Therefore in the discharge wall illustrated in FIG. 5, the same reference numerals are used for the same components.

The material being ground 14 is conveyed from the discharge wall into the discharge cone 16 and passed on into the discharge housing 17. The discharge cone 16 has a greater diameter than the discharge wall. As a result, the speed of the air stream 10 is further reduced, so that the material being ground 14 and the air remain separated.

The invention claimed is:

1. A lifting wall for a tube mill, comprising:

a front face which is provided in inlet openings through which material being ground passes into the wall, a rear face with discharge openings through which the material being ground which is located in the lifting wall is discharged, a central air duct for an air stream which is led through the tube mill, wherein the air duct has an air intake opening in a front face and an air outlet opening in a rear face of the lifting wall and the discharge openings are disposed in an annular region around the air outlet opening, and a discharge means with lifting vanes which transport the material being ground to the discharge openings by rotary movement of the tube mill, wherein the lifting vanes are disposed obliquely with respect to a radial direction of the lifting wall, and the lifting vanes are substantially flat and bent like blades in a region of the discharge openings.

2. A lifting wall as claimed in claim 1, wherein the lifting vanes are disposed at an angle of 15 to 30° with respect to the radial direction.

3. A lifting wall as claimed in claim 1, wherein some of the lifting vanes are adjustable in length.

4. A lifting wall as claimed in claim 1, wherein some of the lifting vanes are adjustable in length, wherein each of these lifting vanes includes a fixed part and a slide which is displaceable in the longitudinal direction of the lifting vanes.

5. A lifting wall as claimed in claim 1, wherein at least some of the lifting vanes extend from an outer casing of the lifting wall as far as the discharge openings.

6. A lifting wall as claimed in claim 1, wherein at least some of the lifting vanes reach from an outer peripheral wall of the lifting wall as far as the discharge openings, but the lifting vanes only extend over about 30 to 70% of a cross-sectional surface of the lifting wall.

7. A lifting wall as claimed in claim 1, wherein in a region of the discharge openings, the lifting vanes have a vane head which forms a vertical limit and is disposed at an angle between about 30 and 60° to longitudinal extent of the lifting vanes so that the material sliding to the vane head is led through the discharge openings.

8. A lifting wall as claimed in claim 1, wherein some of the lifting vanes are adjustable in length by way of a displacement mechanism which can be actuated in a region of the air duct.

9. A lifting wall as claimed in claim 1, wherein at least some of the lifting vanes reach from an outer peripheral wall of the lifting wall as far as the discharge openings, but the lifting vanes only extend over about 50% of a cross-sectional surface of the lifting wall.

* * * * *